US008684384B2

(12) United States Patent
Spicer et al.

(10) Patent No.: US 8,684,384 B2
(45) Date of Patent: Apr. 1, 2014

(54) PROCESS FOR CRACKING A HEAVY HYDROCARBON FEEDSTREAM

(75) Inventors: David B. Spicer, Houston, TX (US); Caleb M. Scherer, Helena, AL (US); James M. Frye, Baytown, TX (US); Subramanian Annamalai, Singapore (SG)

(73) Assignee: ExxonMobil Chemical Patents Inc., Houston, TX (US)

( * ) Notice: Subject to any disclaimer, the term of this patent is extended or adjusted under 35 U.S.C. 154(b) by 820 days.

(21) Appl. No.: 12/437,063

(22) Filed: May 7, 2009

(65) Prior Publication Data

US 2010/0174130 A1 Jul. 8, 2010

Related U.S. Application Data

(60) Provisional application No. 61/142,537, filed on Jan. 5, 2009.

(51) Int. Cl.
*C10G 9/16* (2006.01)

(52) U.S. Cl.
USPC ..... 280/130; 208/106; 208/125; 208/128; 208/129; 208/132; 585/648; 585/650; 585/652

(58) Field of Classification Search
USPC ..... 585/500, 648, 650, 652; 208/106, 125, 208/128, 130, 129, 132
See application file for complete search history.

(56) References Cited

U.S. PATENT DOCUMENTS 3,365,387 A 1/1968 Cahn et al.
3,557,241 A 1/1971 Kivlen et al.

(Continued)

FOREIGN PATENT DOCUMENTS

EP 0 591 856 4/1994
WO WO 94/14923 7/1994

OTHER PUBLICATIONS

Speight, et al., "Thermal Cracking" in Petroleum Refining Processes, Marcel Dekker, 2002.*

(Continued)

*Primary Examiner* — In Suk Bullock
*Assistant Examiner* — Bradley Etherton

(57) ABSTRACT

A process for cracking a hydrocarbon feedstream containing non-volatile components in a hydrocarbon cracking furnace having upper and lower convection heating sections within a flue of the furnace, a radiant heating section downstream of and connected to said lower convection heating section, a transfer line exchanger downstream of and connected to said radiant heating section, a furnace box containing furnace burners and said radiant heating section, and a vapor/liquid separator vessel connected between the upper and lower convection heating sections, the process comprising (a) passing said hydrocarbon feedstream into said upper convection section to heat said hydrocarbon feedstream to a first temperature sufficient to flash at least a portion of the hydrocarbons within said hydrocarbon feedstream into a vapor phase to form a vapor/liquid stream; (b) passing said vapor/liquid stream out of said upper convection section and into said vapor/liquid separator to separate said vapor/liquid stream into a hydrocarbon-containing vapor phase and a hydrocarbon-containing liquid phase within said vapor/liquid separator; (c) collecting said liquid phase into a bottoms liquid within said vapor/liquid separator; (d) passing said vapor phase into said radiant heating section and cracking hydrocarbons in said vapor phase to form an olefins-containing effluent stream; and (e) periodically injecting an air-steam mixture into said convection heating section, then through said vapor/liquid separator to incinerate coke formed and passing an incinerated coke residue/air-steam mixture so-formed between the furnace burners within the furnace box.

12 Claims, 1 Drawing Sheet

(56) References Cited

U.S. PATENT DOCUMENTS

| | | | | |
|---|---|---|---|---|
| 3,647,907 | A | 3/1972 | Takehiko et al. | |
| 4,444,697 | A | 4/1984 | Gater et al. | |
| 4,499,055 | A | 2/1985 | DiNicolantonio et al. | |
| 5,186,815 | A | 2/1993 | Lenglet | |
| 5,580,443 | A | 12/1996 | Yoshida et al. | |
| 6,298,651 | B1 * | 10/2001 | Iijima | 60/780 |
| 6,632,351 | B1 * | 10/2003 | Ngan et al. | 208/132 |
| 6,877,980 | B2 | 4/2005 | Stephens et al. | |
| 7,090,765 | B2 | 8/2006 | Spicer et al. | |
| 7,097,758 | B2 | 8/2006 | Stell et al. | |
| 7,138,047 | B2 | 11/2006 | Stell et al. | |
| 7,193,123 | B2 | 3/2007 | Stell et al. | |
| 7,220,887 | B2 | 5/2007 | Stell et al. | |
| 7,235,705 | B2 | 6/2007 | Stell | |
| 7,244,871 | B2 | 7/2007 | Stell et al. | |
| 7,247,765 | B2 | 7/2007 | Stell et al. | |
| 7,285,697 | B2 | 10/2007 | Keusenkothen | |
| 7,297,833 | B2 | 11/2007 | Beattie et al. | |
| 7,311,746 | B2 | 12/2007 | Stell et al. | |
| 7,312,371 | B2 | 12/2007 | Stell et al. | |
| 7,351,872 | B2 | 4/2008 | Stell et al. | |
| 7,358,413 | B2 | 4/2008 | Stell et al. | |
| 7,402,237 | B2 | 7/2008 | McCoy et al. | |
| 7,408,093 | B2 | 8/2008 | Stell et al. | |
| 7,481,871 | B2 | 1/2009 | Frye et al. | |
| 2005/0209495 | A1 * | 9/2005 | McCoy et al. | 585/648 |
| 2006/0089519 | A1 * | 4/2006 | Stell et al. | 585/648 |
| 2006/0129012 | A1 | 6/2006 | Frye et al. | |
| 2007/0004952 | A1 | 1/2007 | McCoy et al. | |
| 2007/0193729 | A1 | 8/2007 | Spicer et al. | |
| 2008/0128330 | A1 | 6/2008 | McCoy et al. | |
| 2009/0030254 | A1 | 1/2009 | Spicer | |
| 2009/0050530 | A1 | 2/2009 | Spicer et al. | |
| 2009/0085234 | A1 | 4/2009 | Spicer et al. | |
| 2009/0301935 | A1 | 12/2009 | Spicer et al. | |
| 2010/0006478 | A1 | 1/2010 | Spicer | |
| 2010/0063342 | A1 | 3/2010 | Spicer et al. | |

OTHER PUBLICATIONS

Shilling, et al., "Heat Transfer Equipment" in Perry's Chemical Engineers' Handbook, 7th ed., McGraw-Hill, 1997.*

* cited by examiner

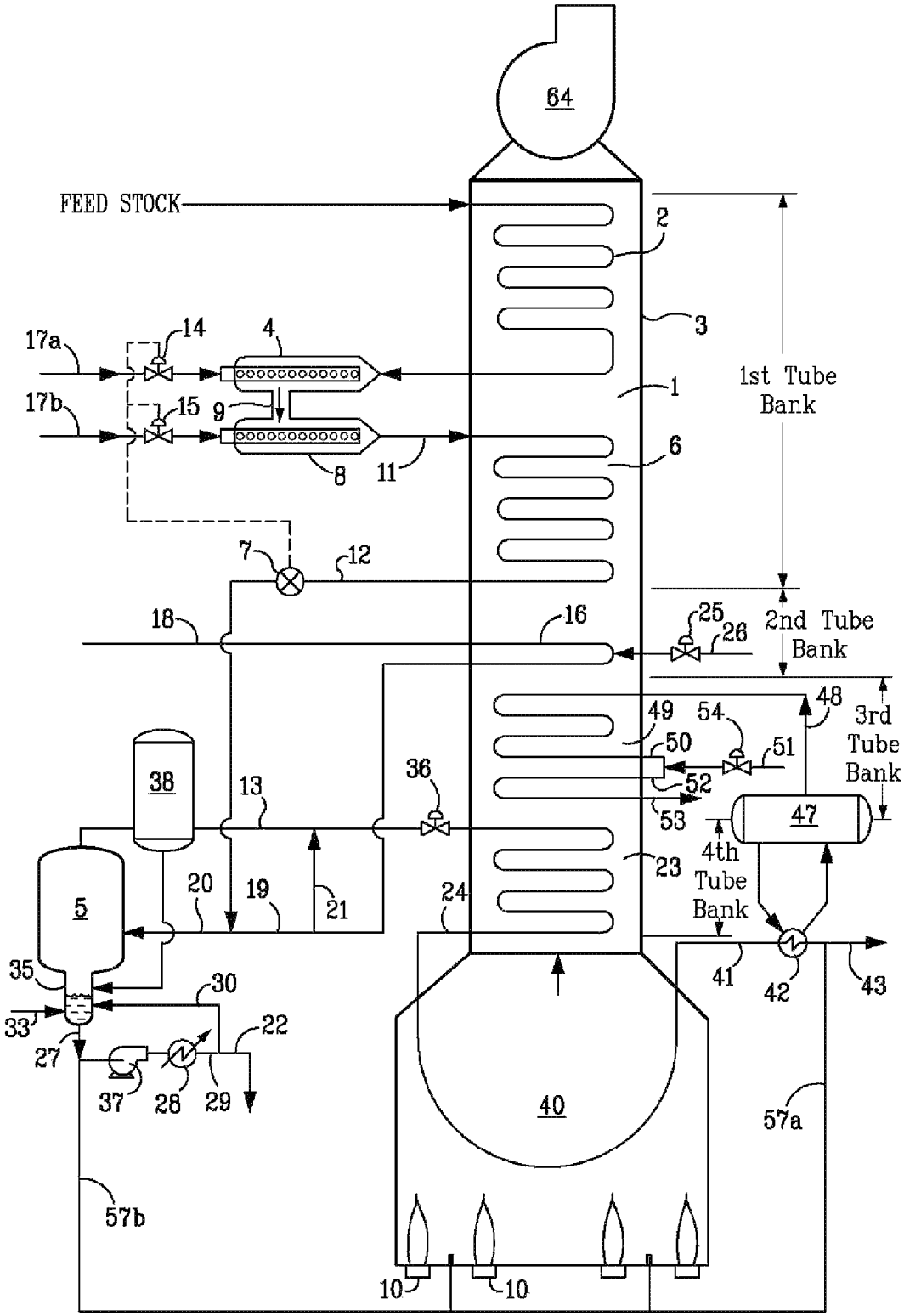
64
FEED STOCK
2
3
1st Tube Bank
1
6
17a
14
4
17b
15
9
8
11
7
12
18
16
25
26
2nd Tube Bank
48
3rd Tube Bank
49
54
50
51
52
53
47
4th Tube Bank
23
38
13
36
5
20
19
21
24
35
30
33
27
22
37
28
29
40
41
42
43
57a
57b
10
10

PROCESS FOR CRACKING A HEAVY HYDROCARBON FEEDSTREAM

CROSS-REFERENCE TO RELATED APPLICATIONS

This application claims priority to application Ser. No. 61/142,537, filed Jan. 5, 2009, which is hereby incorporated by reference.

FIELD

The present invention provides for an integrated process for cracking heavy hydrocarbon feedstocks which maximizes throughput and olefin effluent from the pyrolysis furnace, while minimizing the environmental footprint of the pyrolysis process.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace which has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products including olefins leave the pyrolysis furnace for further downstream processing, including quenching.

Conventional steam cracking systems have been effective for cracking high-quality feedstocks which contain a large fraction of light volatile hydrocarbons, such as gas oil and naphtha. However, steam cracking economics sometimes favor cracking lower cost heavy feedstocks such as, by way of non-limiting examples, crude oil and atmospheric residue. Crude oil and atmospheric residue often contain high molecular weight, non-volatile components with boiling points in excess of 590° C. (1100° F.). The non-volatile components of these feedstocks lay down as coke in the convection section of conventional pyrolysis furnaces. Only very low levels of non-volatile components can be tolerated in the convection section downstream of the point where the lighter components have fully vaporized.

To address coking problems, U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

In using a flash to separate heavy liquid hydrocarbon fractions from the lighter fractions which can be processed in the pyrolysis furnace, it is important to effect the separation so that most of the non-volatile components depart the separator in the liquid bottoms stream. Otherwise, heavy, coke-forming non-volatile components in the vapor are carried into the furnace causing coking problems. However, the flashing in a flash/separation vessel (also referred to herein as a "vapor/liquid separator") is typically accompanied by coking of internal surfaces in and proximally downstream of the vessel. The extent of such coking is dependent upon various factors including feed type, preheating protocol, and design of the vessel. Heavy hydrocarbon liquids contacting the internal surfaces of the vessel and downstream equipment provide coatings of films that are precursors to coke. Excessive temperatures in the separator vessel and downstream vapor piping, such as above about 427° C. (800° F.), typically from about 450 to about 460° C. (840 to about 860° F.) or from about 510 to above about 621° C. (950 to 1150° F.), depending on the feedstock, are theorized to lead to excessive coke formation by thermal cracking and heat soaking of the heavy end of the heavy hydrocarbon feedstock stream. Because this coke buildup can effect restriction and increase pressure drop within the overall process, it would be advantageous to control the coke buildup within the flash zone and immediately downstream of the flash zone.

U.S. Pat. No. 7,244,871, which is incorporated herein by reference, discloses a process for removing coke formed during cracking of hydrocarbon feedstock containing resid and coke precursors, wherein steam is added to the feedstock to form a mixture which is thereafter separated into a vapor phase and a liquid phase by flashing in a flash/separation vessel. The vapor phase is then separated and cracked and the resulting cracked product recovered. Coking of internal surfaces in and proximally downstream of the vessel is controlled by interrupting the feed flow, purging the vessel with steam, introducing an air/steam mixture to at least partially combust the coke, and resuming the feed flow when sufficient coke has been removed.

Controlling the ratio of vapor to liquid leaving the flash has been found to be difficult because many variables are involved, including the temperature of the stream entering the flash, which varies as the furnace load changes. The temperature is higher when the furnace is at full load and is lower when the furnace is at partial load. The temperature of the stream entering the flash also varies according to the flue-gas temperature in the furnace that heats the feedstock. The flue-gas temperature in turn varies according to the extent of coking that has occurred in the furnace. When the furnace is clean or very lightly coked, the flue-gas temperature is lower than when the furnace is heavily coked. The flue-gas temperature is also a function of the combustion control exercised on the burners of the furnace. When the furnace is operated with low levels of excess oxygen in the flue gas, the flue-gas temperature in the middle to upper zones of the convection section will be lower than that when the furnace is operated with higher levels of excess oxygen in the flue gas.

U.S. Pat. No. 7,138,047, which is incorporated herein by reference, describes an advantageously controlled process to optimize the cracking of volatile hydrocarbons contained in the heavy hydrocarbon feedstocks and to reduce and avoid coking problems. It provides a method to maintain a relatively constant ratio of vapor to liquid leaving the flash by maintaining a relatively constant temperature of the stream entering the flash. More specifically, the constant temperature of the flash stream is maintained by automatically adjusting the amount of a fluid stream mixed with the heavy hydrocarbon feedstock prior to the flash. The fluid can be water. To avoid coke deposition in the first stage of preheating in the convection section (and excessive coking in the radiant and quench sections) the mixed and partially vaporized feed and dilution steam stream is generally withdrawn from the convection section before the feed is fully vaporized and before excessive film temperatures are developed in the convection section tubes. Excessive film temperatures, such as above about 510°

C. (950° F.) to above about 620° C. (1150° F.) depending on the feedstock, are theorized to lead to excessive coke formation from the heavy end of the heavy hydrocarbon feedstock stream.

Further efforts to reduce coking after the flash are disclosed in U.S. Published Patent Application No. 2005/0209495, which is incorporated herein by reference, which discloses a process for cracking heavy hydrocarbon comprising heating the heavy hydrocarbon feedstock, mixing the heavy hydrocarbon feedstock with a fluid and/or a primary dilution steam stream to form a mixture, flashing the mixture to form a vapor phase and a liquid phase, separating and cracking the vapor phase, and cooling the product effluent in a transfer line exchanger, wherein the amount of the fluid and/or the primary dilution steam stream mixed with the heavy hydrocarbon feedstock is varied in accordance with at least one selected operating parameter of the process, such as the temperature of the flash stream before entering the flash/liquid separator vessel.

However, even in light of the aforementioned advances, coking of the various internal contact surfaces of a pyrolysis furnace remains a problem. In the past, removal of coke from one or more of the furnace sections required interrupting the normal production schedule of the furnace to conduct the decoking process. Such interruptions can cause serious economic problems during the period of time that the furnace is off-stream.

Efforts to address this problem are disclosed in U.S. Pat. No. 3,365,387, which is incorporated herein by reference, which discloses a process of decoking of a minor portion of the thermal cracking tubes in a furnace while the major portion of the thermal cracking tubes remain in service processing hydrocarbon feed and producing olefin products, conventionally known as "on-stream decoking". A further improvement of the on-stream decoking process is disclosed in U.S. patent application Ser. No. 12/172,048, filed Jul. 11, 2008, which is incorporated herein by reference, which is directed to on-stream decoking of a more modern pyrolysis furnace design, containing multiple banks of tubing within the convection section of the furnace and a vapor/liquid separator vessel upstream of the radiant section of the furnace.

However, prior decoking methods either resulted in sending coke residues into decoking drums and venting gases such as CO and $CO_2$ into the atmosphere, or in the case of on-stream decoking, sending coke residues further downstream through the system to be removed later in the process. In either case, it was necessary to collect the coke residues and send it to off-site waste disposal.

SUMMARY

In one aspect, the present application is directed to a process for cracking a hydrocarbon feedstream containing non-volatile components in a hydrocarbon cracking furnace having upper and lower convection heating sections within a flue of the furnace, a radiant heating section downstream of and connected to said lower convection heating section, a transfer line exchanger downstream of and connected to said radiant heating section, a furnace box containing furnace burners and said radiant heating section, and a vapor/liquid separator vessel connected between the upper and lower convection heating sections, the process comprising (a) passing said hydrocarbon feedstream into said upper convection section to heat said hydrocarbon feedstream to a first temperature sufficient to flash at least a portion of the hydrocarbons within said hydrocarbon feedstream into a vapor phase to form a vapor/liquid stream; (b) passing said vapor/liquid stream out of said upper convection section and into said vapor/liquid separator to separate said vapor/liquid stream into a hydrocarbon-containing vapor phase and a hydrocarbon-containing liquid phase within said vapor/liquid separator; (c) collecting said liquid phase into a bottoms liquid within said vapor/liquid separator; (d) passing said vapor phase into said radiant heating section and cracking hydrocarbons in said vapor phase to form an olefins-containing effluent stream; and (e) periodically injecting an air-steam mixture into said convection heating section, then through said vapor/liquid separator to incinerate coke formed and passing an incinerated coke residue/air-steam mixture so-formed between the furnace burners within the furnace box.

In another embodiment, the process includes preheating said hydrocarbon feedstream prior to step (a) with heat extracted from said bottoms liquid.

In another embodiment, the process includes injecting dilution steam into said heated vapor/liquid stream.

In another embodiment, the process includes passing said hydrocarbon-containing vapor phase into said lower convection section prior to step (d).

In another embodiment, the process includes varying a draft within said furnace flue with a draft control system comprising at least one furnace fan disposed downstream of the convection heating section with respect to said furnace draft.

In another embodiment, the process includes injecting a stripping gas into a boot section of said vapor/liquid separator to enhance removal of hydrocarbon vapor from said bottoms liquid.

In another embodiment, the process includes quenching said olefins-containing effluent stream in the transfer line exchanger, forming steam.

In another embodiment, the process includes passing the incinerated coke residue/air-steam mixture of step (e) from said vapor/liquid separator through said lower convection heating section, said radiant heating section and said transfer line exchanger, prior to passing it between the furnace burners.

In another embodiment, the process for cracking a hydrocarbon feedstream further comprises passing a portion of the incinerated coke residue/air-steam mixture from said vapor/liquid separator through a bottoms liquid outlet of said vapor/liquid separator, prior to passing it between the furnace burners.

In another embodiment, the present application is directed to a process for reducing the environmental footprint of a hydrocarbon cracking furnace having upper and lower convection heating sections within a flue of the furnace, a radiant heating section downstream of and connected to said lower convection heating section, a transfer line exchanger downstream of and connected to said radiant heating section, a furnace box containing furnace burners and said radiant heating section, and a vapor/liquid separator vessel connected between the upper and lower convection heating sections, the process comprising (a) passing said hydrocarbon feedstream into said upper convection section to heat said hydrocarbon feedstream to a first temperature sufficient to flash at least a portion of the hydrocarbons within said hydrocarbon feedstream into a vapor phase to form a vapor/liquid stream; (b) passing said vapor/liquid stream out of said upper convection section and into said vapor/liquid separator to separate said vapor/liquid stream into a hydrocarbon-containing vapor phase and a hydrocarbon-containing liquid phase within said vapor/liquid separator; (c) collecting said liquid phase into a bottoms liquid within said vapor/liquid separator; (d) passing said vapor phase into said radiant heating section and cracking hydrocarbons in said vapor phase to form an olefins-containing effluent stream; and (e) periodically injecting an air-steam mixture into said convection heating section, then through said vapor/liquid separator to incinerate coke formed and passing an incinerated coke residue/air-steam mixture so-formed between the furnace burners within the furnace box to further incinerate said coke residue and to provide additional heat from said air-steam mixture into said convection section.

In another embodiment, the process includes passing the incinerated coke residue/air-steam mixture of step (e) from said vapor/liquid separator through said lower convection heating section, said radiant section and said transfer line exchanger, prior to passing it between the furnace burners.

Conveniently, when said additional heat is provided to said furnace convection tube banks, the temperature of said upper and lower convection sections increases during step (e).

A further embodiment of the present application is directed to a high thermal efficiency hydrocarbon cracking furnace having a furnace box and a flue, comprising upper and lower convection heating section tube banks within said flue, a hydrocarbon feedstream inlet pipe connected to an inlet of said upper convection heating section, a vapor/liquid separator vessel disposed outside of said furnace and connected between an outlet of said upper convection heating section and an inlet of said lower convection heating section, radiant heating section tube banks disposed within said furnace box and connected to the outlet of said lower convection heating section, a transfer line exchanger outside of said furnace and connected to and downstream of said radiant heating section, a plurality of furnace burners within said furnace box and a decoking recycle system, comprising a first decoking recycle pipe connected downstream of said transfer line exchanger, extending into said firebox and exiting between said furnace burners.

The high thermal efficiency hydrocarbon cracking furnace can also comprise a heat exchanger connected between a bottoms liquid outlet of said vapor/liquid separator and said hydrocarbon feedstream inlet pipe, for extracting heat from a separated bottoms liquid exiting said vapor/liquid separator and transferring said heat to said hydrocarbon feedstream inlet pipe.

The high thermal efficiency hydrocarbon cracking furnace can further comprise coolant fluid piping connected between said transfer line exchanger and another heat exchanger disposed within said furnace flue.

Conveniently, the heat exchanger disposed within said furnace flue is located between said upper and lower convection sections.

The high thermal efficiency hydrocarbon cracking furnace can further comprise a draft control system comprising at least one furnace fan disposed downstream of the convection heating section with respect to said furnace draft.

Conveniently, the draft control system further comprises a fan damper.

In a further embodiment, a second decoking recycle pipe is connected downstream of a bottoms liquid outlet of said vapor/liquid separator vessel and connects to said first decoking recycle pipe.

BRIEF DESCRIPTION OF THE DRAWINGS

FIG. 1 is a schematic diagram of a steam pyrolysis furnace useful for practicing the present invention.

DETAILED DESCRIPTION OF THE EMBODIMENTS

The present invention provides for an integrated process for cracking heavy hydrocarbon feedstocks which maximizes throughput and olefin effluent from the pyrolysis furnace, while minimizing the environmental footprint of the pyrolysis process, by reducing waste generated by the system and more efficiently utilizing thermal energy produced within the furnace itself to run the pyrolysis process as well as other off-site processes.

Unless otherwise stated, all percentages, parts, ratios, etc. are by weight. Unless otherwise stated, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

As used herein, non-volatile components, also referred to as asphaltenes, resids or pitch, are the fraction of a hydrocarbon feed with a nominal boiling point above 590° C. (1100° F.), as measured by ASTM D-6352-98 or D-2887. This invention works very well with non-volatiles having a nominal boiling point above 760° C. (1400° F.). The boiling point distribution of the hydrocarbon feed is measured by Gas Chromatograph Distillation (GCD) by ASTM D-6352-98 or D-2887 extended by extrapolation for materials boiling above 700° C. (1292° F.). Non-volatiles are large, very high molecular weight molecules including coke precursors that remain in the liquid phase as the remainder of the hydrocarbon feed vaporizes, and which can form coke under the operating conditions encountered in the process of the present invention.

The heavy hydrocarbon feedstock can comprise a large portion, such as about 5 to about 50%, of heavy non-volatile components. Such feedstock could comprise, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/residue admixture, naphtha/residue admixture, gas oil/residue admixture, and crude oil.

The heating of the hydrocarbon feedstock can take any form known by those of ordinary skill in the art. However, as shown in the FIGURE, it is preferred that the heating comprises indirect contact of the hydrocarbon feedstock in the upper (farthest from the radiant section) convection section tube bank 2 of the furnace 1 with hot flue gases from the radiant section of the furnace. This can be accomplished, by way of non-limiting example, by passing the hydrocarbon feedstock through a bank of heat exchange tubes 2 located within the convection section 3 of the furnace 1. The heated hydrocarbon feedstock typically has a temperature between about 150 and about 260° C. (300 and 500° F.), such as about 160 to about 230° C. (320 to 450° F.), for example about 170 to about 220° C. (340 to about 430° F.).

As will be understood by those skilled in the art, in commercial operations, all of the tube banks consist of multiple, parallel-flow systems of tubes, not merely a single tube within the furnace, as described in U.S. Pat. No. 3,557,241. Thus, any one or more than one flow path can be isolated by appropriate valving, thereby permitting a decoking cycle to be run on one or more selected off-stream tubing flow-paths, without disturbing the overall hydrocarbon pyrolysis process in the remaining on-stream tubes. Even individual banks of tubes can be so-isolated, as disclosed in U.S. patent application Ser. No. 12/172,048 (FIG. 1).

The heated hydrocarbon feedstock is mixed with primary dilution steam and optionally, a fluid which can be a hydrocarbon, preferably liquid but optionally vapor; water, steam, or a mixture thereof. The preferred fluid is water. A source of the fluid can be low pressure boiler feed water. The temperature of the fluid can be below, equal to, or above the temperature of the heated feedstock.

The mixing of the heated hydrocarbon feedstock and the fluid can occur inside or outside the pyrolysis furnace 1, but preferably it occurs outside the furnace. The mixing can be accomplished using any mixing device known within the art. For example, it is possible to inject fluid from line 17*a* into a first sparger 4 of a double sparger assembly 9 for the mixing. The first sparger 4 can avoid or reduce hammering, caused by sudden vaporization of the fluid, upon introduction of the fluid into the heated hydrocarbon feedstock.

The present invention uses steam streams in various parts of the process. The primary dilution steam stream 17*b* can be mixed with the heated hydrocarbon feedstock as detailed below. In another embodiment, a secondary dilution steam stream 18 can be heated in the convection section and mixed with the heated mixture stream before the flash. The source of the secondary dilution steam may be primary dilution steam that has been superheated, optionally in a convection section of the pyrolysis furnace. Either or both of the primary and secondary dilution steam streams may comprise sour or process steam. Superheating the sour or process dilution steam minimizes the risk of corrosion that could result from condensation of sour or process steam.

In one embodiment of the present invention, in addition to the fluid mixed with the heated feedstock, the primary dilution steam 17*b* is also mixed with the feedstock. The primary dilution steam stream can be preferably injected into a second sparger 8. It is preferred that the primary dilution steam stream is injected into the hydrocarbon fluid mixture before the resulting stream mixture enters the convection section through pipe 11 for additional heating by flue gas.

The primary dilution steam can have a temperature greater, lower or about the same as hydrocarbon feedstock fluid mixture but preferably the temperature is greater than that of the mixture and serves to partially vaporize the feedstock/fluid mixture. The primary dilution steam may be superheated before being injected into the second sparger 8.

The mixture stream comprising the heated hydrocarbon feedstock, the fluid, and the primary dilution steam leaving the second sparger 8 is optionally heated again in the convection section of the pyrolysis furnace 3 before the flash. The heating can be accomplished, by way of non-limiting example, by passing the mixture stream through a bank of heat exchange tubes 6 located within the convection section, usually as part of the first, upper convection section tube bank, of the furnace and thus heated by the hot flue gas from the radiant section of the furnace. The thus-heated mixture stream leaves the convection section as a mixture stream 12.

Optionally, the secondary dilution steam stream 18 can be further split into a flash steam stream 19 which is mixed with the hydrocarbon mixture 12 before the flash and a bypass steam stream 21 which bypasses the flash of the hydrocarbon mixture and, instead can be mixed with the vapor phase from the flash/liquid separator 5 before the vapor phase is cracked in the radiant section of the furnace. The present invention can operate with all secondary dilution steam 18 used as flash steam 19 with no bypass steam 21. Alternatively, the present invention can be operated with secondary dilution steam 18 directed to bypass steam 21 with no flash steam 19. In accordance with the present invention, the ratio of the flash steam stream 19 to bypass steam stream 21 can be 1:20 to 20:1, and even 1:2 to 2:1. In this embodiment, the flash steam 19 is mixed with the hydrocarbon mixture stream 12 to form a flash stream 20 which can be introduced tangentially into flash/liquid separator vessel 5. Preferably, the secondary dilution steam stream is superheated in a superheater section 16 in the furnace convection before splitting and mixing with the hydrocarbon mixture. The addition of the flash steam stream 19 to the hydrocarbon mixture stream 12 aids the vaporization of most volatile components of the mixture before the flash stream 20 enters the flash/liquid separator vessel 5.

The mixture stream 12 or the flash stream 20 is then flashed, for example in a flash/liquid separator vessel 5, for separation into two phases: a vapor phase comprising predominantly volatile hydrocarbons and steam and a liquid phase that contains the great majority of the non-volatile hydrocarbons, including coke precursors. The vapor phase is removed from the flash/liquid separator vessel as an overhead vapor stream 13 and fed via control valve 36 to a lower convection section tube bank 23 of the furnace, preferably located nearest the radiant section of the furnace, for optional additional heating and through crossover pipes 24 to the radiant section of the pyrolysis furnace for cracking. The liquid phase of the flashed mixture stream is removed from the flash/liquid separator vessel 5 as a bottoms stream 27, which contains most of the coke precursors. However, some coke precursors are unavoidably left on the interior surfaces of the flash/liquid separator vessel.

It is preferred to maintain a predetermined constant ratio of vapor to liquid in the flash/liquid separator vessel 5, but such ratio is difficult to measure and control. As an alternative, temperature of the mixture stream 12 before the flash/liquid separator vessel 5 can be used as an indirect parameter to measure, control, and maintain an approximately constant vapor to liquid ratio in the flash/liquid separator vessel 5. Ideally, when the mixture stream temperature is higher, more volatile hydrocarbons will be vaporized and become available, as a vapor phase, for cracking. However, when the mixture stream temperature is too high, more heavy hydrocarbons will be present in the vapor phase and carried over to the convection furnace tubes, eventually coking the convection tubes, the radiant section tubes, and the tubes in the transfer-line exchanger 42. If the mixture stream 12 temperature is too low, resulting in a low ratio of vapor to liquid in the flash/liquid separator vessel 5, more volatile hydrocarbons will remain in liquid phase and thus will not be available for cracking.

The mixture stream temperature is limited by highest recovery/vaporization of volatiles in the feedstock while avoiding excessive coking in the furnace convection and radiant tubes or coking in piping and vessels conveying the mixture from the flash/liquid separator vessel to the furnace 1 via line 13 or coking in the transfer-line exchanger 42 tubes. The pressure drop across the piping 13 conveying the mixture to the lower convection section 23, and the crossover piping 24, and the temperature rise and pressure drop across lower convection section 23 may be monitored to detect the onset of coking problems. For instance, when the crossover pressure and process inlet pressure to the lower convection section 23 begins to increase rapidly due to coking as indicated by a rapid opening of control valve 36, the temperature in the flash/liquid separator vessel 5 and the mixture stream 12 should be reduced or the feed rate reduced. If coking occurs in the lower convection section, the temperature of the flue gas to the superheater 16 increases, requiring more desuperheater water 26.

The selection of the mixture stream 12 temperature is also determined by the composition of the feedstock materials. When the feedstock contains higher amounts of lighter hydrocarbons, the temperature of the mixture stream 12 can be set lower and still provide an attractive vapor/liquid split in separator 5. As a result, the amount of fluid used in the first sparger 4 would be increased and/or the amount of primary dilution steam used in the second sparger 8 would be decreased since these amounts directly impact the temperature of the mixture stream 12. When the feedstock contains a higher amount of heavy hydrocarbons, the temperature of the mixture stream 12 should be set higher. As a result, the amount of fluid used in the first sparger 4 would be decreased while the amount of primary dilution steam used in the second sparger 8 would be increased. By carefully selecting a mixture stream temperature, the present invention can find applications in a wide variety of feedstock materials.

Typically, the temperature of the mixture stream 12 can be set and controlled at between about 315 and about 540° C. (600 and 1000° F.), such as between about 370 and about 510° C. (700 and 950° F.), for example between about 400 and about 480° C. (750 and 900° F.), and often between about 430 and about 475° C. (810 and 890° F.). These values will change with the boiling curve of the hydrocarbon feedstock as discussed above.

Considerations in determining the temperature include the desire to maintain a liquid phase to reduce the likelihood of coke formation on convection tube walls upstream of the vapor/liquid separator and in the flash/liquid separator.

The temperature of mixture stream 12 can be controlled by a control system 7 which comprises at least a temperature sensor and any known control device, such as a computer application. Preferably, the temperature sensors are thermocouples. The control system 7 communicates with the fluid valve 14 and the primary dilution steam valve 15 so that the amount of the fluid and the primary dilution steam entering the two spargers can be controlled.

In order to maintain a constant temperature for the mixture stream 12 mixing with flash steam 19 and entering the flash/liquid separator vessel to achieve a constant ratio of vapor to liquid in the flash/liquid separator vessel 5, and to avoid substantial temperature and flash vapor to liquid ratio variations, the present invention operates as follows: When a temperature for the mixture stream 12 before the flash/liquid separator vessel 5 is set, the control system 7 automatically controls the fluid valve 14 and primary dilution steam valve 15 on the two spargers. When the control system 7 detects a drop of temperature of the mixture stream, it will cause the fluid valve 14 to reduce the injection of the fluid 17*a* into the first sparger 4. If the temperature of the mixture stream starts to rise, the fluid valve will be opened wider to increase the injection of the fluid into the first sparger 4.

When the primary dilution steam stream 17*b* is injected to the second sparger 8, the temperature control system 7 can also be used to control the primary dilution steam valve 15 to adjust the amount of primary dilution steam stream injected to the second sparger 8. This further reduces the sharp variation of temperature changes in the flash 5. When the control system 7 detects a drop of temperature of the mixture stream 12, it will instruct the primary dilution steam valve 15 to increase the injection of the primary dilution steam stream into the second sparger 8 while valve 14 is closed more. If the temperature starts to rise, the primary dilution steam valve will automatically close more to reduce the primary dilution steam stream injected into the second sparger 8 while valve 14 is opened wider.

In an example embodiment where the fluid is water, the controller varies the amount of water and primary dilution steam to maintain a constant mixture stream temperature 12, while maintaining a constant ratio of water+steam-to-feedstock in the mixture 11. To further avoid sharp variation of the flash temperature, the present invention also preferably utilizes an intermediate desuperheater 25 in the superheating section of the secondary dilution steam in the furnace. This allows the superheater 16 outlet temperature to be controlled at a constant value, independent of furnace load changes, coking extent changes, excess oxygen level changes, and other variables. Normally, this desuperheater 25 maintains the temperature of the secondary dilution steam between about 425 and about 590° C. (800 and 1100° F.), for example between about 455 and about 540° C. (850 and 1000° F.), such as between about 455 and about 510° C. (850 and 950° F.), and typically between about 470 and about 495° C. (875 and 925° F.). The desuperheater can be a control valve and optional water atomizer nozzle. After partial preheating, the secondary dilution steam exits the convection section and a fine mist of water from line 26 can be added which rapidly vaporizes and reduces the temperature. The steam is preferably then further heated in the convection section. The amount of water added to the superheater can control the temperature of the steam which is mixed with mixture stream 12.

Although the description above is based on adjusting the amounts of the fluid and the primary dilution steam streams injected into the hydrocarbon feedstock in the two spargers 4 and 8, according to the predetermined temperature of the mixture stream 12 before the flash/liquid separator vessel 5, the same control mechanisms can be applied to other parameters at other locations. For instance, the flash pressure and the temperature and the flow rate of the flash steam 19 can be changed to effect a change in the vapor to liquid ratio in the flash. Also, excess oxygen in the flue gas can also be a control variable, albeit, possibly a slow one.

An alternative or additional method of controlling the ratio of vapor to liquid leaving the flash/liquid separator vessel is disclosed in U.S. Pat. No. 7,351,872, which is incorporated herein by reference. The pyrolysis furnace 1 is equipped with a draft management system, including at least a fan 64 disposed downstream of the convection sections, with respect to the direction of the furnace draft, which can be adjusted to vary the volume of flue gas drawn through the furnace flue and thereby adjust the temperature of the hot mixture stream, vapor stream or flash stream. The speed of the furnace fan can be varied in response to the change in the draft. For example, an increase in the speed of the furnace fan will cause an increase in the draft, which will increase flue gas oxygen and thus will increase the temperature in the convection section 2. In an alternative embodiment, the fan may operate at constant speed and the draft may be varied by modulating fan inlet dampers. Other components of the draft management system comprise dampers (not illustrated) to the burners 10, furnace stack dampers (not illustrated) or any combination of the above.

In addition to maintaining a constant temperature of the mixture stream 12 entering the flash/liquid separator vessel, it is generally also desirable to maintain a constant hydrocarbon partial pressure of the flash stream 20 in order to maintain a constant ratio of vapor to liquid in the flash/liquid separator vessel. By way of examples, the constant hydrocarbon partial pressure can be maintained by maintaining constant flash/ liquid separator vessel pressure through the use of control valves 36 on the vapor phase line 13, and by controlling the ratio of steam to hydrocarbon feedstock in stream 20. The vapor phase line 13 contains a trace of condensed vapor phase in addition to the vapor phase. These trace amounts of condensed vapor phase are typically less than about 3 wt %, say, less than about 1 wt % of the total overhead stream. However, their presence is highly undesirable inasmuch as these condensates can act as coke precursors.

Typically, the hydrocarbon partial pressure of the flash stream in the present invention is set and controlled at between about 25 and about 830 kpaa (4 and 120 psia), such as between about 35 and about 100 kPaa (5 and 15 psia), for example between about 40 and about 75 kPaa (6 and 11 psia).

In one embodiment, the flash is conducted in at least one flash/liquid separator vessel. Typically the flash is a one-stage process with or without reflux. The flash/liquid separator vessel 5 is normally operated at about 275 to about 1400 kPag (40 to 205 psig) pressure and its temperature is usually the same or slightly lower than the temperature of the flash stream 20 before entering the flash/liquid separator vessel 5. Typically, the temperature at which the flash/liquid separator vessel operates is about 310 to about 540° C. (600 to about 1000° F.). For example, the pressure of the flash can be about 600 to about 1100 kPag (85 to 155 psig) and the temperature can be about 370 to about 490° C. (700 to 920° F.). As a further example, the pressure of the flash can be about 700 to about 1000 kPag (105 to 145 psig) with a temperature of about 400 to about 480° C. (750 to 900° F.). In yet another example, the pressure of the flash/liquid separator vessel can be about 700 to about 800 kPag (105 to 115 psia) and the temperature can be about 430 to about 475° C. (810 to 890° F.). Depending on the temperature of the mixture stream 12, generally about 50 to about 98% of the mixture stream being flashed is in the vapor phase, such as about 60 to about 95%, for example about 65 to about 90%.

The flash/liquid separator vessel 5 is generally operated, in one aspect, to maintain the liquid phase at the bottom of the vessel at a temperature sufficiently low to prevent liquid phase thermal cracking from occurring rapidly enough to form coke in the bottom of the separator. Use of the secondary dilution steam stream 18 in the flash stream entering the flash/liquid separator vessel lowers the vaporization temperature because it reduces the partial pressure of the hydrocarbons (i.e., a larger mole fraction of the vapor is steam) and thus lowers the required liquid phase temperature. It may also be helpful to recycle a portion of the externally cooled flash/liquid separator vessel bottoms liquid 30 back to the flash/liquid separator vessel to help cool the newly separated liquid phase at the bottom of the flash/liquid separator vessel 5. Stream 27 can be conveyed from the bottom of the flash/liquid separator vessel 5 to the cooler 28 via pump 37. In one embodiment the bottoms liquid stream 27 can be cooled by the incoming feedstock in cooler 28, and conversely heats the feedstock to help maximize the thermal efficiency of the system. The cooled stream 29 can then be split into a recycle stream 30 and export stream 22. The temperature of the recycled stream would typically be about 500 to about 600° F. (260 to 315° C.), for example 520 to 550° F. (270 to 290° C.). The amount of recycled stream can be about 80 to about 250% of the amount of the newly separated bottom liquid inside the flash/liquid separator vessel, such as 90 to 225%, for example, 100 to 200%.

The flash is generally also operated, in another aspect, to minimize the liquid retention/holding time in the flash vessel. In one example embodiment, the liquid phase is discharged from the vessel through a small diameter "boot" or cylinder 35 on the bottom of the flash/liquid separator vessel. Typically, the liquid phase retention time in the drum is less than 75 seconds, for example, less than 60 seconds, such as less than 30 seconds, and often less than 15 seconds. The shorter the liquid phase retention/holding time in the flash/liquid separator vessel, the less coking occurs in the bottom of the flash/liquid separator vessel.

A further improvement in recovery of desired volatile components from the flash/liquid separator can be achieved by introducing a stripping gas into the boot 35 of the separator vessel 5 through pipe 33. The stripping gas can comprise any non-reactive gas, such as steam, nitrogen, hydrocarbon gases or the like, with superheated secondary dilution steam being the preferred embodiment. U.S. Published Patent Application No. 2006/0129012, which is incorporated herein by reference, discloses such a system.

Although it is the preferred embodiment for stream 27 to flow out of the bottom of the boot 35, stream 27 can be can be located as a side drawoff the boot 35 or the low section of flash/liquid separator vessel 5.

The vapor phase exiting the flash/liquid separator vessel 5 may contain, for example, 55 to 70% hydrocarbons and 30 to 45% steam. The boiling end point of the vapor phase is normally below about 760° C. (1400° F.), such as below about 590° C. (1100° F.), and often below about 565° C. (1050° F.). The vapor phase is continuously removed from the flash/liquid separator vessel 5 through overhead pipe 13, which optionally conveys the vapor to a centrifugal separator 38 to remove trace amounts of entrained and/or condensed liquid. The vapor then typically flows into a manifold that distributes the flow to the convection section of the furnace.

The vapor phase stream 13 continuously removed from the flash/liquid separator vessel is preferably superheated in the pyrolysis furnace lower convection section 23 to a temperature of, for example, about 425 to about 705° C. (800 to 1300° F.) by the flue gas from the radiant section 40 of the furnace. The vapor phase is then introduced to the radiant section 40 of the pyrolysis furnace to be cracked.

The vapor phase stream 13 removed from the flash/liquid separator vessel can optionally be mixed with a bypass steam stream 21 before being introduced into the furnace lower convection section 23.

The superheating after the mixing of the bypass steam 21 with the vapor phase stream 13 ensures that all components of the mixture in this section of the furnace are vaporized before entering the radiant section 40. Raising the temperature of vapor phase to about 425 to about 705° C. (800 to 1300° F.) in the lower convection section 23 also helps the operation in the radiant section since radiant tube metal temperature can be reduced. This results in less coking potential in the radiant section. The superheated vapor 24 is then cracked in the radiant section 40 of the pyrolysis furnace to produce an effluent comprising olefins, including ethylene and other desired light olefins, and byproducts which is passed to a recovery train for recovery of products.

Unique to the present invention is a first decoking recycle pipe 57*a*, extending from line 43 just downstream of the transfer-line exchanger 42, to positions between burners 10 in the firebox of the pyrolysis furnace. This system permits the effluent from decoking cycles, such as coke residue, air/steam mixture and CO gas, to be deposited within the firebox and between the burners, resulting in further incineration of coke residue. A smaller flow of air/steam mixture can be drawn from the bottom of the separator through a second decoking recycle pipe 57*b* during decoking, and mixed with the main decoking recycle effluent before injection into the radiant firebox. This second air/steam flow ensures that coke is removed from the bottom of the separator vessel. Accordingly, while prior art processes of decoking required disposal of coke residue at off-site waste disposal sites, the present process reduces or eliminates decoking waste products within the pyrolysis furnace itself. Optimally, floor burners such as those disclosed in U.S. Pat. No. 6,877,980, which is incorporated herein by reference, are used in the firebox.

Importantly, sending the effluent from the decoking cycles into the furnace box/burners also transfers additional heat resulting from the decoking process into the furnace convection section, thus enhancing the efficiency of the removal of coke from convection section tubes.

The radiant section effluent 41 resulting from cracking a heavy hydrocarbon feedstock in the present invention can be rapidly cooled in a transfer-line exchanger 42, generating high pressure steam 48 in a thermosyphon arrangement with a steam drum 47.

The steam generated in transfer line exchangers can be used to drive large steam turbines which power the major compressors used elsewhere in the ethylene production unit. To obtain high energy efficiency and power production in the steam turbines, it is necessary to superheat the steam produced in the transfer line exchangers. For example, in a nominal 10,340 kPag (1500 psig) steam system, the steam would be produced at approximately 315° C. (600° F.) and would be superheated in the convection section of the furnace to about 425 to 590° C. (800 to about 1100° F.), for example about 455 to 510° C. (850 to about 950° F.) before being consumed in the steam turbines.

The saturated steam 48 taken from the drum is preferably superheated in the high pressure steam superheater bank 49. To achieve the optimum turbine inlet steam temperature at all furnace operating conditions, an intermediate desuperheater (or attemperator) 54 may be used in the high pressure steam superheater bank. This allows the superheater 49 outlet temperature to be controlled at a constant value, independent of furnace load changes, coking extent changes, excess oxygen level changes, and other variables. Normally, this desuperheater 54 would maintain the temperature of the high pressure steam between about 425 and 590° C. (800 and about 1100° F.), for example between about 450 and 540° C. (850 and about 1000° F.), such as between about 450 and 510° C. (850 and about 950° F.). The desuperheater can be a control valve and water atomizer nozzle. After partial heating, the high pressure steam 50 exits the convection section and a fine mist of water from line 51 is added which rapidly vaporizes and reduces the temperature. The high pressure steam 52 is then returned to the convection section to be further heated and exits at line 53 for other uses in the ethylene production facility, as mentioned above. The amount of water added to the superheater can control the temperature of the steam.

To enhance the ability to control coking of the desired heavy hydrocarbon feedstock streams in the first tube bank, the high pressure steam superheater can be located in the convection section such that it is downstream (with respect to the flow of flue gas from the radiant section of the furnace) of the vapor phase superheater and upstream of the first tube bank. Since both superheaters are located within the furnace flue/convection section, they not only act to superheat steam for running other processes and steam turbines, but also to quench the furnace flue gas, as needed.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

We claim:

1. A process for cracking a hydrocarbon feedstream containing non-volatile components in a hydrocarbon cracking furnace having upper and lower convection heating sections within a flue of the furnace, a radiant heating section downstream of and connected to said lower convection heating section, a transfer line exchanger downstream of and connected to said radiant heating section, a furnace box containing furnace burners and said radiant heating section, and a vapor/liquid separator vessel connected between the upper and lower convection heating sections, the process comprising:

(a) passing said hydrocarbon feedstream into said upper convection section to heat said hydrocarbon feedstream to a first temperature sufficient to flash at least a portion of the hydrocarbons within said hydrocarbon feedstream into a vapor phase to form a vapor/liquid stream;

(b) passing said vapor/liquid stream out of said upper convection section and into said vapor/liquid separator to separate said vapor/liquid stream into a hydrocarbon-containing vapor phase and a hydrocarbon-containing liquid phase within said vapor/liquid separator;

(c) collecting said liquid phase into a bottoms liquid within said vapor/liquid separator;

(d) passing said vapor phase into said radiant heating section and cracking hydrocarbons in said vapor phase to form an olefins-containing effluent stream; and (e) periodically injecting an air-steam mixture into said convection heating section, then through said vapor/liquid separator to incinerate coke formed and passing an incinerated coke residue/air-steam mixture so-formed between the furnace burners within the furnace box.

2. The process for cracking a hydrocarbon feedstream according to claim 1, further comprising preheating said hydrocarbon feedstream prior to step (a) with heat extracted from said bottoms liquid.

3. The process for cracking a hydrocarbon feedstream according to claim 1, further comprising injecting dilution steam into said heated vapor/liquid stream.

4. The process for cracking a hydrocarbon feedstream according to claim 1, further comprising passing said hydrocarbon-containing vapor phase into said lower convection section prior to step (d).

5. The process for cracking a hydrocarbon feedstream according to claim 1, further comprising varying a draft within said furnace flue with a draft control system comprising at least one furnace fan disposed downstream of the convection heating section with respect to said furnace draft.

6. The process for cracking a hydrocarbon feedstream according to claim 1, further comprising injecting a stripping gas into a boot section of said vapor/liquid separator to enhance removal of hydrocarbon vapor from said bottoms liquid.

7. The process for cracking a hydrocarbon feedstream according to claim 1, further comprising quenching said olefins-containing effluent stream in said transfer line exchanger, forming steam.

8. The process for cracking a hydrocarbon feedstream according to claim 1, further comprising passing the incinerated coke residue/air-steam mixture of step (e) from said vapor/liquid separator through said lower convection heating section, said radiant heating section and said transfer line exchanger, prior to passing it between the furnace burners.

9. The process for cracking a hydrocarbon feedstream according to claim 1, further comprising passing a portion of the incinerated coke residue/air-steam mixture from said vapor liquids separator through a bottoms liquid outlet of said vapor/liquid separator, prior to passing it between the furnace burners.

10. A process for reducing the environmental footprint of a hydrocarbon cracking furnace having upper and lower convection heating sections within a flue of the furnace, a radiant heating section downstream of and connected to said lower convection heating section, a transfer line exchanger downstream of and connected to said radiant heating section, a furnace box containing furnace burners and said radiant heating section, and a vapor/liquid separator vessel connected between the upper and lower convection heating sections, the process comprising:

(a) passing said hydrocarbon feedstream into said upper convection section to heat said hydrocarbon feedstream to a first temperature sufficient to flash at least a portion of the hydrocarbons within said hydrocarbon feedstream into a vapor phase to form a vapor/liquid stream;

(b) passing said vapor/liquid stream out of said upper convection section and into said vapor/liquid separator to separate said vapor/liquid stream into a hydrocarbon-containing vapor phase and a hydrocarbon-containing liquid phase within said vapor/liquid separator;

(c) collecting said liquid phase into a bottoms liquid within said vapor/liquid separator;

(d) passing said vapor phase into said radiant heating section and cracking hydrocarbons in said vapor phase to form an olefins-containing effluent stream; and (e) periodically injecting an air-steam mixture into said convection heating section, then through said vapor/liquid separator to incinerate coke formed and passing an incinerated coke residue/air-steam mixture so-formed between the furnace burners within the furnace box to further incinerate said coke residue and to provide additional heat from said air-steam mixture into said convection sections.

11. The process for reducing the environmental footprint of a hydrocarbon cracking furnace according to claim 10, further comprising passing the incinerated coke residue/air-steam mixture of step (e) from said vapor/liquid separator through said lower convection heating section, said radiant heating section, and said transfer-line exchanger, prior to passing it between the furnace burners.

12. The process for reducing the environmental footprint of a hydrocarbon cracking furnace according to claim 10, wherein said additional heat provided to said furnace box increases the temperature of said upper and lower convection sections during step (e), thus increasing efficiency of decoking.

* * * * *